United States Patent [19]

Joppe et al.

[11] 4,278,247

[45] Jul. 14, 1981

[54] WATER SLIDE

[76] Inventors: R. Brent Joppe, 1547 Parkhurst, NW., Grand Rapids, Mich. 49504; Leonard F. Postema, R.R. #7, Morganton, N.C. 28655

[21] Appl. No.: 16,359

[22] Filed: Feb. 26, 1979

[51] Int. Cl.[3] ..... A63G 21/18

[52] U.S. Cl. ..... 272/56.5 R; 104/70; 4/494

[58] Field of Search ..... 272/56.5 R, 56.5 SS, 272/32, 1 B, 71, 1 A; 4/172, 172.19, 488, 494, 496, 505, 506, 513; 104/58, 59, 69, 70, 72, 73; 405/79, 118, 119; 182/40, 41, 48, 49, 51, 52, 179; D25/2, 41

[56] References Cited

U.S. PATENT DOCUMENTS

| | | | |
|---|---|---|---|
| 159,959 | 2/1875 | Parker | 405/119 |
| 182,422 | 9/1876 | Dike et al. | 405/119 |
| 1,135,764 | 4/1915 | Casey | 4/494 |
| 1,648,196 | 11/1927 | Rohmer | 272/56.5 X |
| 2,859,967 | 11/1958 | Planck | 272/1 B |
| 3,603,046 | 9/1971 | Humphrer, Jr. | D25/2 X |
| 3,814,021 | 6/1974 | McHenry | 104/69 |
| 3,923,301 | 12/1975 | Myers | 272/56.5 R |
| 4,149,710 | 4/1979 | Rouchard | 272/56.5 R |
| 4,194,733 | 3/1980 | Whitehouse, Jr. | 104/70 X |
| 4,198,043 | 4/1980 | Timbes et al. | 272/56.5 R |

*Primary Examiner*—Richard C. Pinkham
*Assistant Examiner*—Arnold W. Kramer
*Attorney, Agent, or Firm*—Price, Heneveld, Huizenga & Cooper

[57] ABSTRACT

A water slide includes a trough or tube having an entry end elevated with respect to a recovery end for conveying water and individuals from the entry end to the recovery end. A loading platform extends into a starting pool and is designed to allow easy and safe access from the rear and both sides to provide entry to the trough. The flow of water into the starting pool or reservoir cascades over and onto the loading platform and then into the trough in a steady manner. Steps are provided into this pool to allow access to the loading platform. At the recovery end of the trough, an elongated recovery ramp is provided to allow exit off the water slide at a variety of positions.

13 Claims, 8 Drawing Figures

WATER SLIDE

BACKGROUND OF THE INVENTION

The present invention relates to water slides.

It has generally been a practice in the water slide industry to have one position from which one may enter the water slide. Because of this, those waiting to get onto the slide generally line up behind the entrance to the slide in a single file manner. This slows down access to the slide and creates long waiting periods in line. The entries to most water slides are also very difficult for the average person and because of such difficulty are very much lacking in safety requirements.

A feature of most water slides which further increases the time necessary to allow one person to use a slide is that exit off the slide into a pool is generally at one spot in the recovery pool. This necessitates, for safety reasons, a delay period during which time the last person off the slide must swim away from the spot in the pool at which people exit off the water slide and into the pool. Also, because of the difference in speed of persons using the slide, accidents occur by reason of one person hitting another at the recovery end of the slide.

A further feature of present water slides is the use of a gushing torrent of water in which people are propelled down the water slide. This rate of flow of water increases the cost of present water slides by requiring larger pumps.

Thus, there is a need for entry systems which allow the rapid and safe handling of a large volume of people. There is also a need for a recovery system which prevents individuals from landing on top of each other. Finally, there is a need for introducing water into the water slide in a less forceful way than is presently done, and which reduces the total amount of water required while at the same time allowing a rapid rate of acceleration and excitement which is generally expected out of a water slide.

SUMMARY OF THE INVENTION

The water slide which is the subject of the present invention satisfies these needs by providing a unique entry system and a unique recovery system.

In accordance with the present invention, the entry system includes a multiple position loading platform located at the entry end of the trough and which extends into a starting pool or water reservoir which surrounds the platform at the rear and two sides. Water is pumped into the starting pool and cascades or spills over the edges of the loading platform and into the entry end of the water slide. The platform is in effect a seat on which one can easily sit down from a standing position in the pool or reservoir. Located at points spaced around the starting pool are side railings which permit one using the slide to mount the platform while maintaining a grip on the side railings. The loading platform, by virtue of it being surrounded by the pool at the rear and the sides, allows access to it from both sides and rear.

A multiple position dumping ramp is provided at the recovery end of the trough. This ramp, which is elongated, sloped and open along an extended distance, allows individuals to exit the water slide and enter the water at a variety of different points according to the weight and speed of the rider.

These and other features, objects and advantages of the present invention can best be understood by reference to the following description thereof together with the drawings in which:

DETAILED DESCRIPTION OF THE PREFERRED EMBODIMENT

Figure 1:
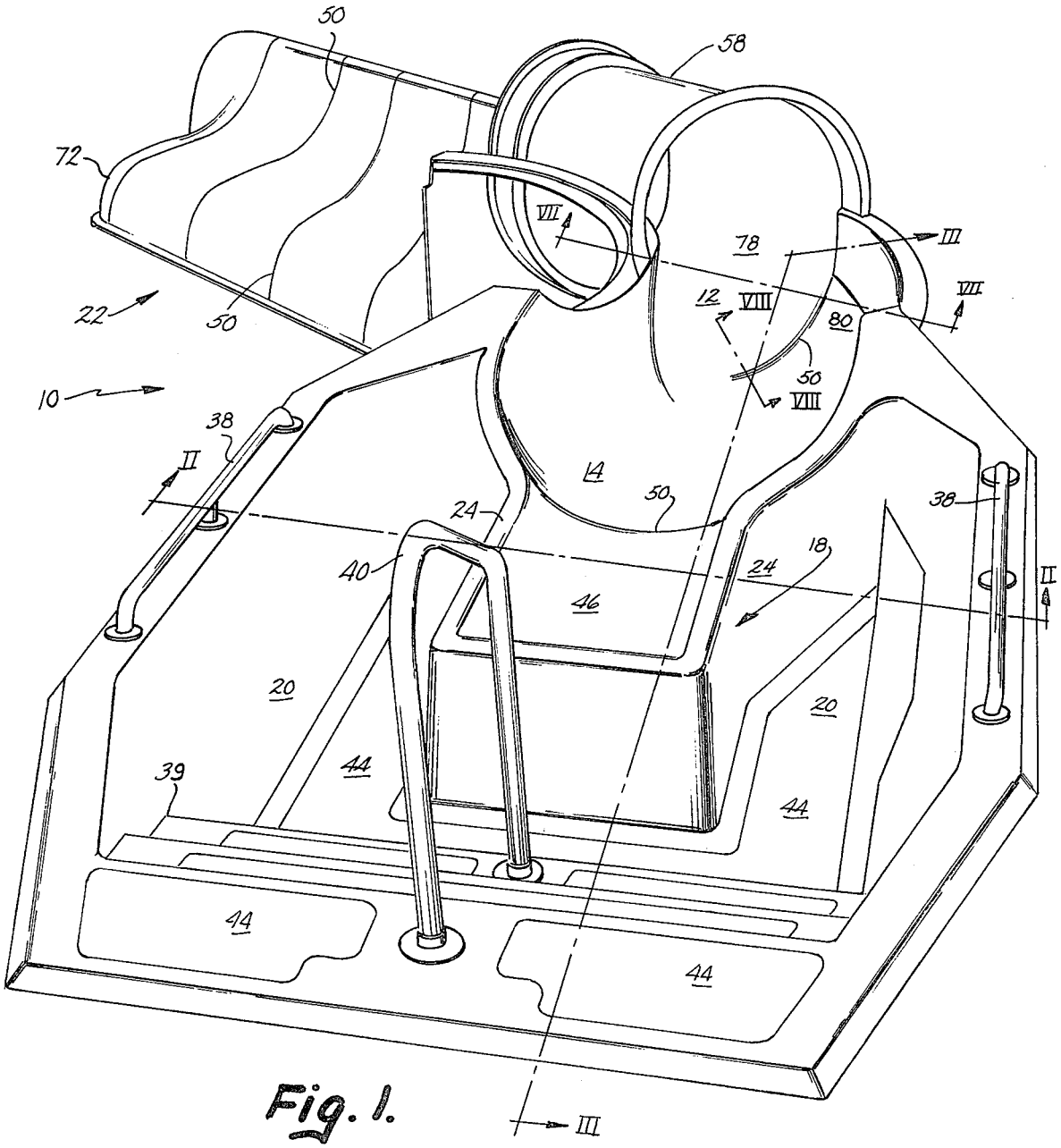
FIG. 1 is a perspective view of the water slide of the present invention.

Referring now to the drawings, and particularly to FIG. 1, there is shown a water slide 10 in a perspective view. A trough 12 is used to convey water and individuals from a first or entry end 14 elevated with respect to and forward of a second or recovery end 16. A multiple position loading platform 18 is provided at the entry end 14 of the trough 12. Surrounding the multiple position loading platform 18 is a water reservoir 20 into which platform 18 extends. Water from the water reservoir 20 continuously spills over the three edges 24 of the multiple position loading platform 18 and into the entry end 14 of the trough 12. A multiple position exit ramp 22 is provided and allows individuals to exit the water slide 10 at various points along its length.

Figure 3:
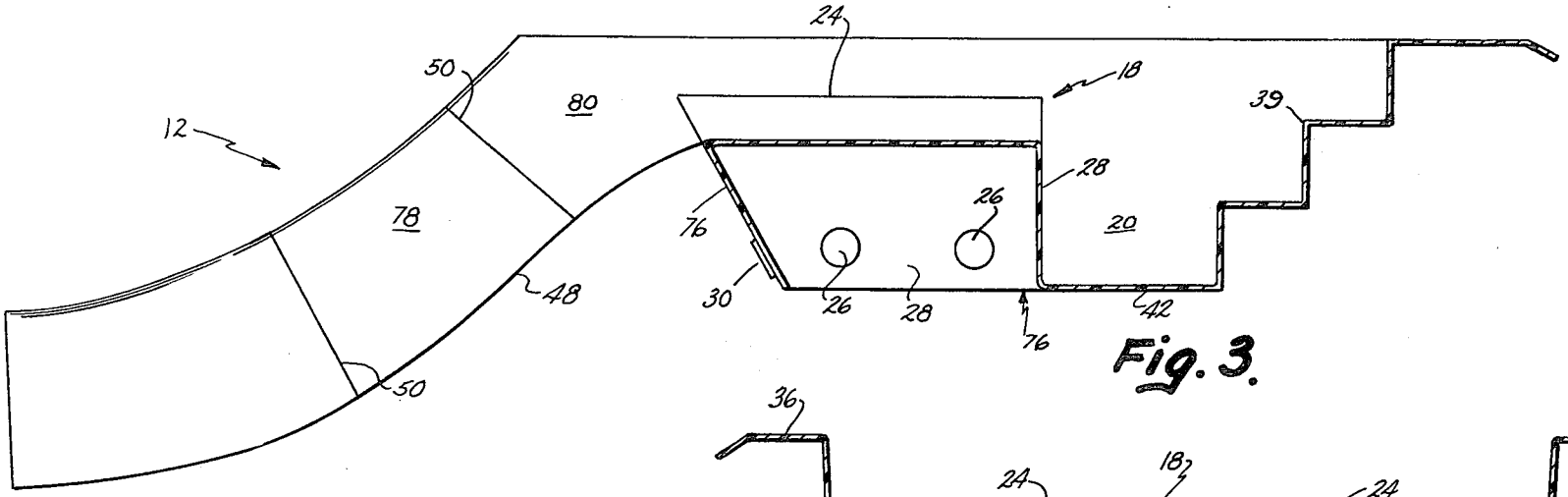
FIG. 3 is a longitudinally-extending cross-section taken along line III—III of FIG. 1.
Figure 2:
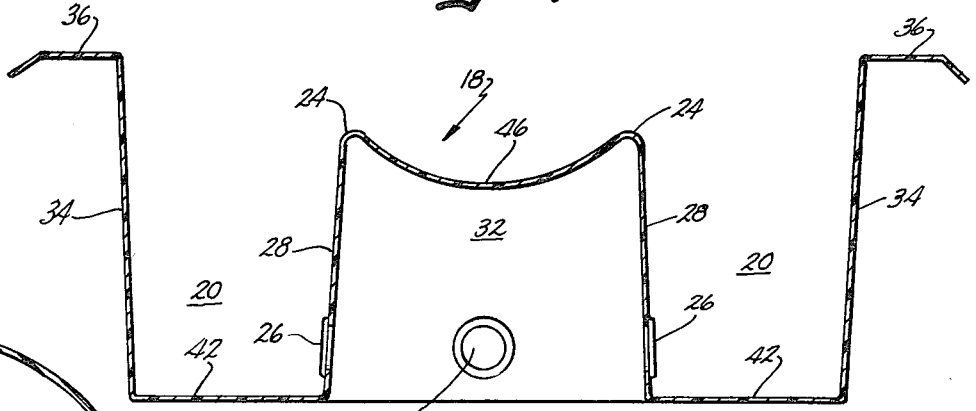
FIG. 2 is a transverse cross-section taken along line II—II of FIG. 1.

More specifically, and referring to FIGS. 1–3, a water reservoir or starting pool 20 is provided which continuously supplies water to the trough 12 of the water slide 10 by flowing over the smooth, rounded edges 24 of the platform 18 and then flowing into trough 12. The water reservoir 20 is supplied water via four water outlets 26, two of which are located on the side support walls 28 of the multiple position loading platform 18. The water outlets 26 are supplied water by filling a holding tank 32 located inside the multiple position loading platform 18 by means of a water inlet 30. The four water outlets 26 thus supply water to the water reservoir 20 in such a manner as to prevent turbulence.

The multiple position loading platform 18 and the water reservoir 20 are an integrally-formed one-piece construction made of, by way of example, fiberglass. The water reservoir 20 includes water retaining walls 34 having at their uppermost edge a flange 36 for mounting handrails 38 and the like. The handrails 38 are mounted to the water retaining walls 34 of the water reservoir 20 using conventional mounting means.

At the most forward end of the water slide 10 a plurality of horizontally-extending steps 38 form a part of the water retaining wall 34, and allow easy access into the water reservoir 20. A handrail 40 is positioned on the steps 38 to facilitate safe and easy entry into the starting pool or water reservoir 20.

A water reservoir bottom 42 is provided so that there is room for a number of individuals to be simultaneously within the water reservoir 20 and in a position where they are ready to load onto the multiple position loading platform 18. Finally, and referring to FIG. 1, antislip pads 44 are provided on both the steps 39 and the water reservoir bottom 42 so that individuals can safely enter the water reservoir 20 and walk around without fear of slipping.

An integrally formed part of the multiple position loading platform 18 and the water reservoir or starting pool 20 (see FIG. 2) is a rectangular shaped seat 46 which extends rearwardly from the first end 14 of the trough 12. The seat 46 is 19 inches high which is the most convenient, normal seat height. It is transversely bowed and longitudinally tipped so that it channels water into the first end 14 of the trough 12. The seat 46 is that portion of the multiple position loading platform 18 on which a rider would first position himself when getting ready to embark down the trough 12. As can be seen in FIG. 1, a plurality of individuals can stand around the multiple position loading platform 18 and load onto the seat 46 simply by placing their buttocks onto seat 46 and rotating their legs around and placing them on the first end 14 of the trough 12. This can be done from any position around the multiple loading position platform 18 and reduces the amount of time required to get an individual into position and ready to slide down trough 12. The seat 46 is supported by the integrally formed side support walls 28 and by the first end 14 of the trough 12. The entire starting section or entry system including the starting pool 20, the starting platform 18, and the railings 38 and 40 are scaled to allow a rider to mount the platform 18 while maintaining a grip on the railings. The platform 18 allows access from the rear and sides.

The trough 12 is the means by which water and water slide users are conveyed from the entry end 14 of the trough to the recovery end 16. As can be seen from FIG. 3, the bottom surface 48 of the trough 12 rapidly slopes away from the seat 46 of the multiple position loading platform 18 to provide immediate rapid acceleration at the start of the ride.

Figure 7:
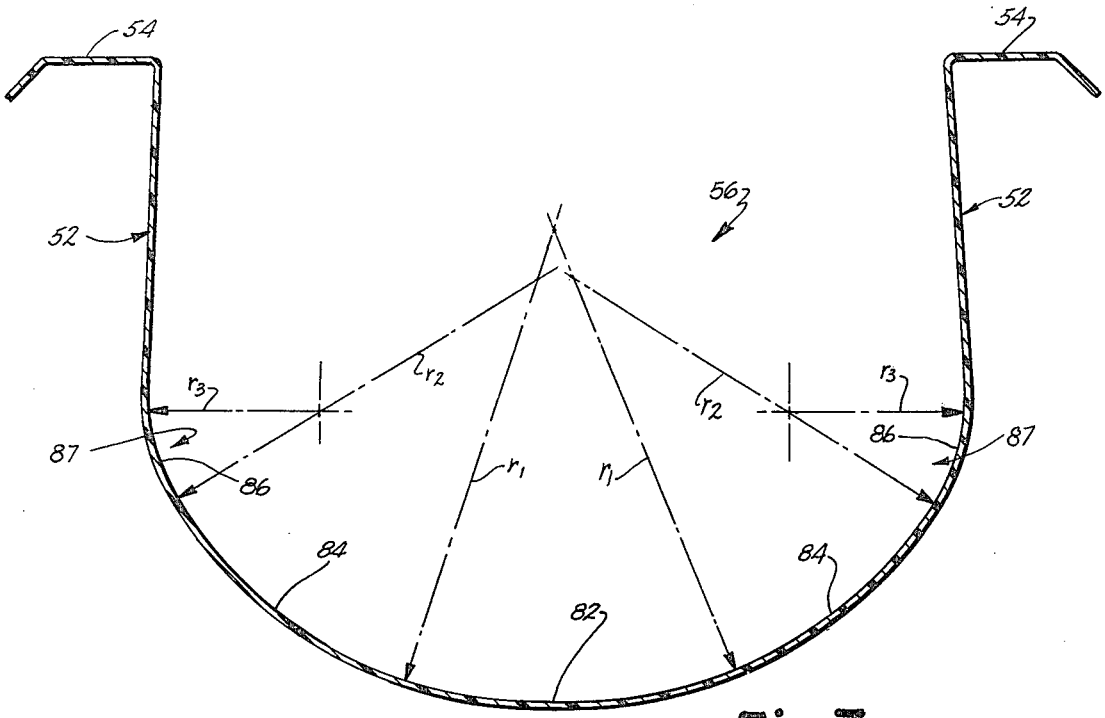
FIG. 7 is a transverse cross-section of the trough of the present invention taken along line VII—VII of FIG. 1.

As can be seen in FIGS. 1 and 3, trough 12 is not a one-piece construction but is composed of a plurality of separate sections joined together at lines 50 by a technique to be discussed later. A representative transverse cross-section of the trough 12 is shown in FIG. 7. Unless the trough 12 has a cap or canopy, each section is a one-piece construction, and referring particularly to FIG. 7, has a generally U-shaped cross-sectional shape. In particular, the cross-section of the trough 12 is composed of oppositely-situated, vertically-extending side walls 52, the upper portion of each of the side walls containing an outwardly-extending flange 54. The curved portion 56 of the trough's U-shaped cross-section is integrally formed with the oppositely-situated, vertically-extending, inwardly sloping side walls 52. In particular, and in the preferred embodiment, the oppositely-situated, vertically-extending side walls each slope inwardly from a true vertical by approximately three degrees. This inward slope forces riders down into pocket 87 when they are going around curves in the trough 12, and additionally helps the rider maintain a constant body position relative to the trough 12 while in the pocket 87. A curved side wall would not allow a rider to maintain a constant body position within pocket 87 at all times, and might lead into a pitch over situation causing the rider to lose contact with the tube.

The transverse radius of the curved portion 56 varies and depends on which transverse position of the curved portion 56 one is situated at. The dotted lines in FIG. 7 represent the various radii hereinafter described, and show how they are generated. In particular, and by way of example only, in the preferred embodiment, approximately one-quarter of that part of the curved portion which is centrally located has a curved shape 82 equalling that of a circle with a 22 inch radius, shown in FIG. 7 as $r_1$. One-quarter of the curved portion 56 situated on each side of the central 22 inch radius portion will have a curved shape 84 equalling that of a circle with a 19 inch radius, $r_2$. Finally, that portion left which is integrally formed with the oppositely-situated, vertically-extending side walls 52 will have a curved shape 86 equalling an arc from a circle with an 11 inch radius, $r_3$. This unique shape provides a pocket 87 in the side wall which allows for maximum acceleration down the central portion of the trough 12 and prevents individuals from riding up too high on the side walls 52 when going around sharp turns in the trough 12. Finally, and referring to FIG. 1, a canopy or cap 58 can be attached to the flanges 54. The canopy 58 adds structural integrity to the trough 12, and additionally adds an element of excitement to a ride down the water slide 10.

Figures 4, 8:
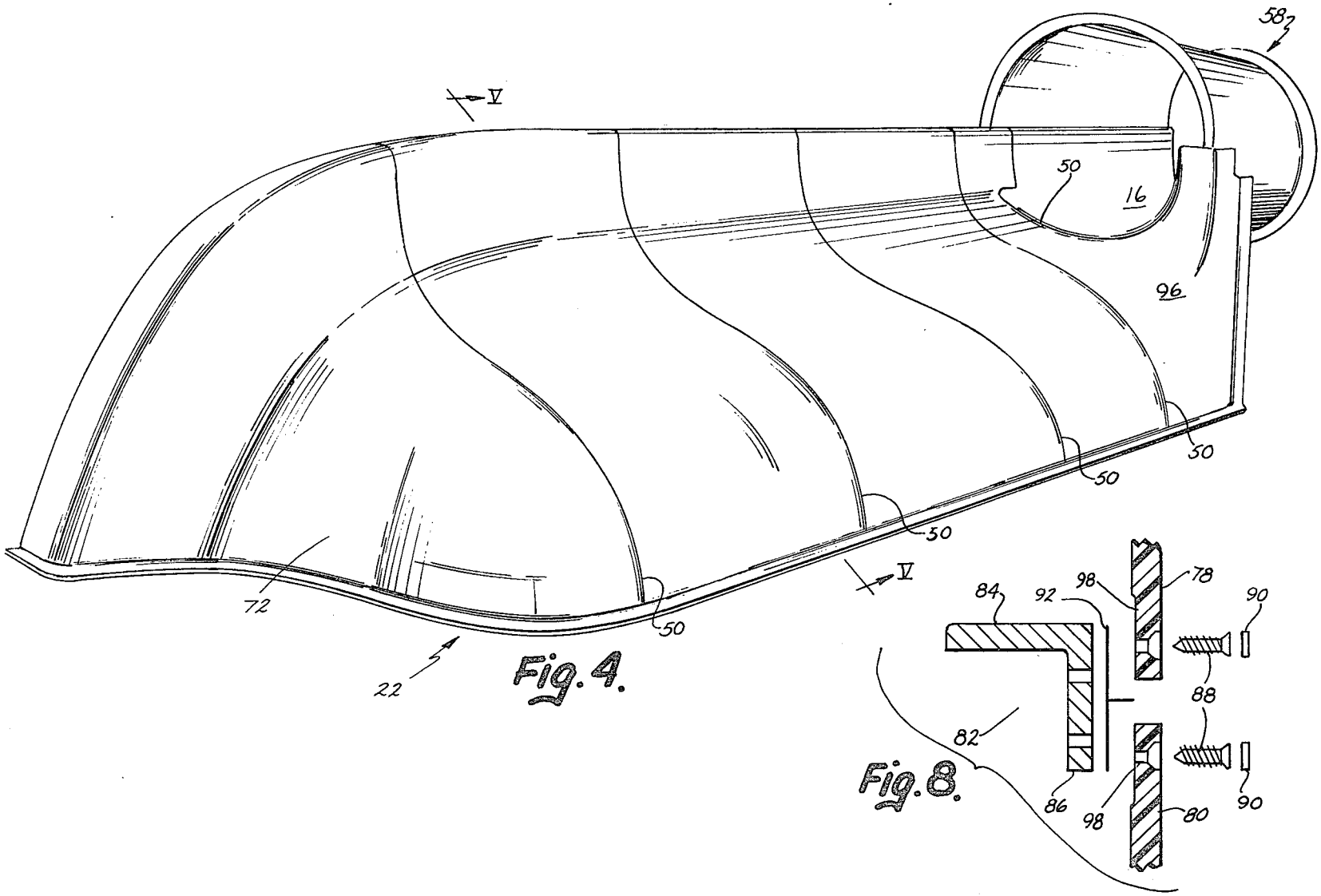
FIG. 4 is a perspective view of the multiple position exit ramp of the present invention.
FIG. 8 is an enlarged longitudinal cross-section showing a representative junction of two individual sections of the water slide taken along line VIII—VIII of FIG. 1.
Figure 5:
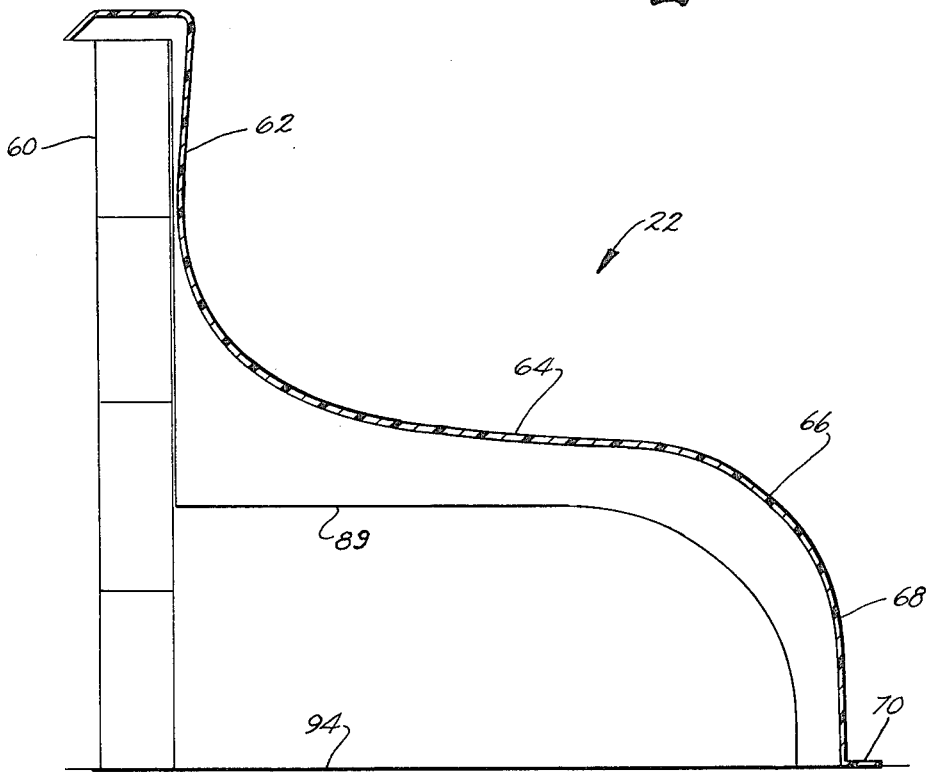
FIG. 5 is a transverse cross-section taken along line V—V of FIG. 4.

Referring to FIGS. 4 and 5, attached to the second or recovery end 16 of the trough 12 is a multiple position exit or recovery ramp 22. The ramp 22 is constructed in sections and joined at lines 50 by bolting adjacent integrally formed flanges 89 of the sections together.

Referring to FIG. 5, the ramp 22 is shown abutted to and supported by a structural wall 60 and the floor 94 of a pool or the like. Each section of the multiple position recovery ramp 22 includes a first longitudinally-extending transverse segment 62 which is an extension of one-half of the trough 12, a second longitudinally-extending transverse segment 64 which slopes away and down from the first segment at a slight angle, a third longitudinally-extending transverse segment 66 which curves much more rapidly towards the ground, and a fourth longitudinally-extending transverse segment 68 which extends vertically towards the ground from the third portion 66 and contains a flange 70 at its bottom-most edge as it contacts the ground. In addition, the exit ramp 22 can have a slight longitudinal slope towards the ground, although in the preferred embodiment the exit ramp 22 is longitudinally level.

As can be seen in FIG. 4, individuals will shoot out of the recovery end 16 of the trough 12 and onto the multiple position exit ramp 22. The exact point at which they will exit the ramp 22 is dependent on a variety of factors, including the weight of the individual and the speed of the individual. In particular, the heavier or faster rider will slide farther down the exit ramp 22 than the lighter or slower rider. It is contemplated that no one will make it to the capping end piece 72 of the ramp 22.

Figure 6:
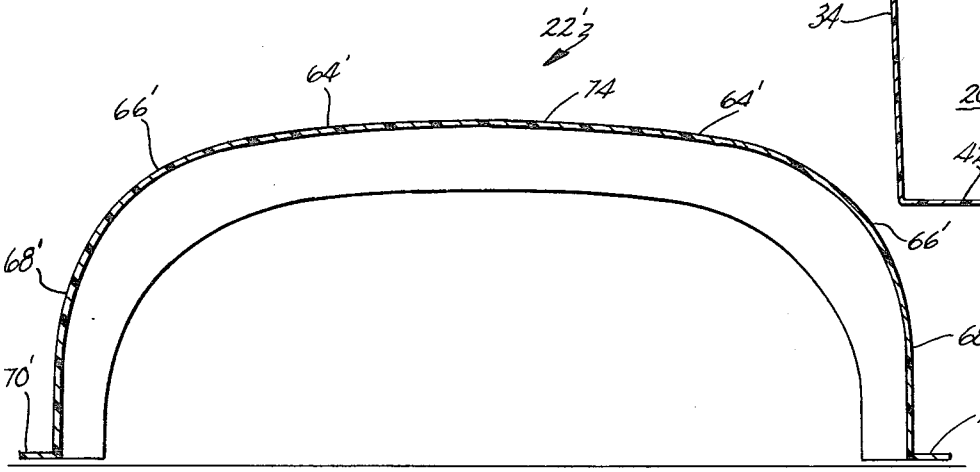
FIG. 6 is a transverse cross-section of an alternate embodiment of the multiple position exit ramp of FIG. 4.

An alternate embodiment of the multiple position exit ramp 22 is shown in FIG. 6. Starting at a midpoint 74 of the alternate multiple position exit ramp 22', a first segment 64' slopes away and down at a slight angle from the midpoint 74. Integrally formed with this first segment 64' is a second segment 66' which slopes away at a greater angle towards the ground, and is integrally formed with a third segment 68' which is vertically-extending and contacts the ground, and has an outwardly-extending flange 70'. As can be seen from comparing FIGS. 5 and 6, the cross section of FIG. 6 uses the shape of the right-hand portion of the multiple position exit ramp 22 as shown in FIG. 5 in a manner symmetric about a midpoint 74. This allows exit off the multiple position exit ramp 22' in either direction.

As previously discussed, the trough 12 is constructed by joining a plurality of individual sections together at lines 50. Each individual section is manufactured by using conventional fiberglassing techniques on previously shaped forms. It should be noted that the area of the water slide 10 which encompasses the multiple position loading platform 18, the water reservoir 20, and the steps 38 is a one-piece construction which is joined to the first end 14 of the trough 12. The holding tank 32 is constructed by fiberglassing a separate backing sheet 76 to the underside of the multiple position loading platform 18, thus forming a water retaining holding tank 32 which is supplied by the water inlet 30. The multiple position exit ramp 22 is also constructed using conventional fiberglassing techniques.

Referring to FIGS. 4 and 8, the first step in joining two separate trough sections together, hereafter referred to as a first section 78 and a second section 80, is to machine the outer surface 98 of each section for a distance of approximately one inch inwardly from the junction of the two sections until the surface is smooth and of a consistent thickness. Sections 78 and 80 are then joined, and an appropriate hardening gel putty 92, for example a catylized polyester resin putty, is applied along this two inch strip. An L-shaped bracket 82, having one side 86 which is two inches wide, is attached to this junction so that side 86 has one inch on section 78 and another inch on section 80 by the use of recessed screws 88. The excess putty is wiped away, and the junction of the two sections 78 and 80, herein called line 50, is touched up, and thus for all purposes is a seamless junction. The area 90 immediately above the recessed screws 88 is capped 90 so that there are no rough edges presented to an individual riding the water slide 10. Finally, the short leg 84 of the L-shaped bracket 82 significantly adds to the structural rigidity of the completed water slide 10. An adapter section 96 (FIG. 4) uses the aforementioned joining technique on the trough 12 side, and uses conventional joining techniques on the exit ramp 22 side.

OPERATION

In operation, a plurality of individuals would load, via steps 39, into the starting pool 20, all of them within reach of a handrail 38 or 40. One at a time, but in a rapid manner, each individual rider would place his buttocks on seat 46 and swing his legs so that they extend into the entry end 14 of trough 12. The individual rider would then give himself a slight push into the trough 12, and would rapidly accelerate down trough 12.

During straight trough 12 runs, the rider would be sliding down the center 82 of the trough 12. While in curved portions of the trough 12, the rider would move up into the pocket 87 of the trough 12 which holds him in the trough.

At the recovery end 16 of the water slide 10, the rider would shoot out onto the recovery ramp 22 and then into the water. The point at which the rider would enter the water, from the ramp 22, depends on his weight and speed. Generally, though, sequential riders will not enter the water at the same point. After entering the water, the rider would then make his way back to the starting pool 20 for another ride.

It will be understood that various changes in the details, materials, steps and arrangement of parts which have been herein described and illustrated in order to explain the nature of the invention may be made by those skilled in the art within the principal and scope of the invention as expressed in the appended claims.

The embodiments of the invention in which an exclusive property or privilege is claimed are defined as follows:

1. A water slide comprising:

a trough for slidingly conveying individual riders on a stream of water from an entry end of said trough to an exit end of said trough; said entry end being elevated with respect to said exit end; said trough having a generally U-shaped cross-section for retaining the riders therein;

means for introducing water into the entry end of said trough;

a loading platform positioned adjacent said entry end of said trough and having a seat with at least two sides from which a rider can load, and another side communicating with said trough entry end;

a starting pool reservoir defined by a floor located below said seat at an elevation which permits the rider to sit down onto said seat from a standing position; said reservoir further including sides extending at a level above said seat for containing water therein above the level of said seat, and means for introducing water into said reservoir; said reservoir surrounding said seat on at least said two sides, whereby the water in said reservoir flows over said seat two sides into said trough to at least contribute to said means for introducing water into the entry end of said trough and also allow riders easy entry onto said seat from multiple positions in said reservoir; and an exit ramp located at said exit end of said trough.

2. A water slide comprising:

a trough for slidingly conveying individual riders on a stream of water from an entry end of said trough to an exit end of said trough; said entry end being elevated with respect to said exit end; said trough having a generally U-shaped cross-section for retaining the riders therein;

means for introducing water into the entry end of said trough;

a loading platform positioned adjacent said entry end of said trough, and having a seat with at least two sides from which a rider can load, and one side communicating with said trough entry end;

a starting pool reservoir defined by a floor located below said seat at an elevation which permits the riders to sit down onto said seat from a standing position; said reservoir further including sides extending at a level above said seat for containing water therein above the level of said seat, and means for introducing water into said reservoir; said reservoir surrounding said seat on at least said two sides, whereby the water in said reservoir flows over said seat two sides into said trough to at least contribute to said means for introducing water into the entry end of said trough and also allow riders easy entry onto said seat from multiple positions in said reservoir.

3. The water slide as defined in claim 1 wherein said seat is rectangularly shaped, extends rearwardly from said entry end of said trough, and is transversely bowed and longitudinally tipped so as to channel water into said entry end of said trough, and further comprising means for supporting said seat so as to allow riders access to said seat from three sides thereof.

4. The water slide as defined in claim 3 wherein said means for supporting said seat comprises:

a vertically-extending support wall, extending from said seat to a base support means, the junction of said support wall and seat seat forming a smooth-rounded edge.

5. The water slide as defined in claim 4 wherein said floor is integrally connected to said support wall and supports said support wall.

6. The water slide as defined in claim 5 further comprising:

a plurality of horizontally extending steps forming a part of said sides, said steps beginning at a top of said sides and ending at said floor of said reservoir; and handrail means on which the rider can maintain a grip while positioning himself on said seat.

7. The water slide as defined in claim 6 in which the handrail means include:

a first handrail extending down the center of said steps leading into the reservoir, and a plurality of second handrails situated on top of said sides.

8. The water slide as defined in claim 7 wherein the structure defining the loading platform and the reservoir is a one-piece, integrally-formed construction.

9. A water slide as set forth in claim 1, including:

a multiple position exit ramp positioned at said exit end of said trough for causing riders to exit transversely of said slide at different longitudinal positions depending upon the weight and speed of the rider to prevent riders from being dumped on each other at the end of the slide.

10. A water slide comprising:

a trough for slidingly conveying individual riders on a stream of water from an entry end of the trough to an exit end of said trough; said entry end being elevated with respect to and forward of said exit end;

means for introducing water onto the entry end of said trough;

a multiple position exit ramp adapted to be located in a recovery pool, and being connected with said exit end of said trough, whereby the water running through said trough flows over said exit ramp; said exit ramp being adapted to extend partially above the level of water in the recovery pool, and having a substantially linear body with a slide surface with a curvilinear cross-section adapted to extend above the level of water and which cross-section slopes transversely of the longitudinal axis of said exit ramp body in a downward direction, for causing riders to exit said slide by sliding transversely over the surface of said exit ramp at different longitudinal positions therealong, depending upon the weight and speed of the rider to prevent riders from being dumped on each other at the end of the slide.

11. The water slide of claim 10 in which the exit ramp on one side has a curvilinear restraining wall extending upwardly for restraining riders, and said curvilinear cross-section sloping transversely and in a downwardly direction is located opposite said upwardly extending wall.

12. The water slide of claim 10 in which both sides of said exit ramp have portions of curvilinear cross-section sloping transversely and in a downward direction from said extension of said exit end of said trough.

13. The water slide as defined in claim 10 wherein said exit ramp at said exit end of said trough comprises:

a plurality of longitudinally extending exit sections, each section comprising a first portion which is an extension of a portion of the trough and a second portion which comprises a first longitudinally-extending transverse segment which slightly slopes away from said first portion, a second longitudinally-extending transverse segment which curves downwardly, and a third longitudinally-extending vertical segment which is adapted to provide a support for the said exit ramp.

* * * * *